United States Patent [19]

Satoh et al.

[11] 4,108,282

[45] Aug. 22, 1978

[54] POSITION-INDICATING SIGNAL EQUIPMENT FOR ELEVATOR

[75] Inventors: Tsuyoshi Satoh; Kenzo Tachino, both of Inazawa, Japan

[73] Assignee: Mitsubishi Denki Kabushiki Kaisha, Tokyo, Japan

[21] Appl. No.: 721,754

[22] Filed: Sep. 9, 1976

[30] Foreign Application Priority Data

Sep. 17, 1975 [JP] Japan ..... 50-112464

[51] Int. Cl.$^2$ ..... B66B 3/02

[52] U.S. Cl. ..... 187/29 R

[58] Field of Search ..... 187/29

[56] References Cited

U.S. PATENT DOCUMENTS

| | | | |
|---|---|---|---|
| 3,425,515 | 2/1969 | McDonald et al. | 187/29 |
| 3,743,055 | 7/1973 | Hoelscher et al. | 187/29 |
| 3,773,146 | 11/1973 | Dixon, Jr. et al. | 187/29 |
| 3,893,695 | 7/1975 | Rickert | 187/29 X |
| 4,009,766 | 3/1977 | Satoh | 187/29 |

*Primary Examiner*—Robert K. Schaefer
*Assistant Examiner*—W. E. Duncanson, Jr.
*Attorney, Agent, or Firm*—Oblon, Fisher, Spivak, McClelland & Maier

[57] ABSTRACT

A position-indicating signal equipment for elevator comprises a present position detector which relatively detects the present position of a cage from the transit distance of the cage;

an absolute floor position memory; and an arithmetic unit which compares and operates the output of the present position detector and the output of the absolute floor position memory to output the signal for indicating the cage position.

5 Claims, 10 Drawing Figures

POSITION-INDICATING SIGNAL EQUIPMENT FOR ELEVATOR

BACKGROUND OF THE INVENTION

The present invention relates to a cage position indicating signal equipment for a digital control type elevator.

Recently, a digital control system has been applied for a control of elevator because of improvement of the electronic circuit technology and the integrated circuit technology.

On the other hand, the conventional position-indication for elevator has been attained by using a mechanical floor selector which is a reduced model for movement of elevator to output the cage position-indicating signals which correspond to a cage position and a cage stoppable position, by using contacts. However, it has a mechanical structure and it moves in reduced movement and accordingly it has been hard to maintain the accuracy of positions for long period because of wear and elongation caused in drivings.

The floor selector is reduced but the height of the floor selector may be several meters in the case of an elevator for high building. It is hard to set in a utility room.

A compact position-indicating signal equipment having high accuracy suitable for a digital controlled elevator has been required, because of the uses of digital control type elevators.

SUMMARY OF THE INVENTION

It is an object of the present invention to provide a position-indicating signal equipment for elevator which has an electrical structure and has high accuracy for long period and is miniature size and is suitable for digital control type elevator.

DETAILED DESCRIPTION OF THE PREFERRED EMBODIMENTS

Figure 1:
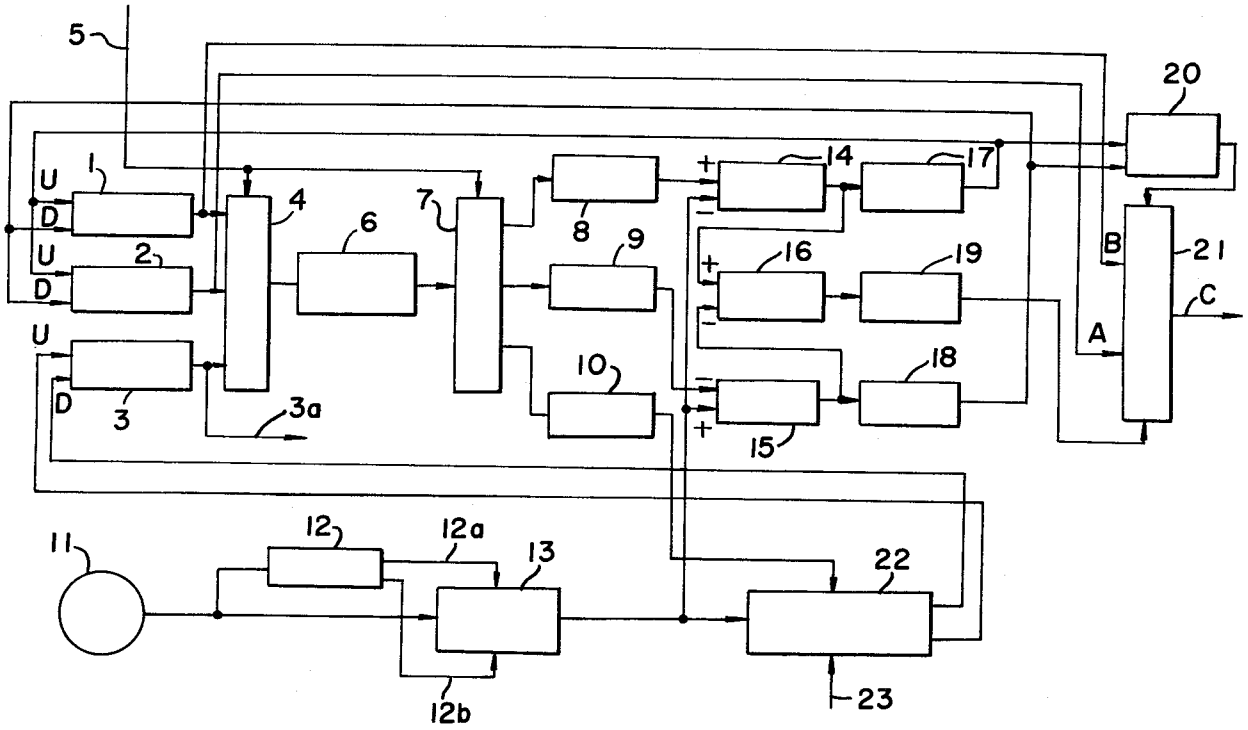
FIG. 1 is a block diagram of one embodiment of the position-indicating signal equipment for elevator according to the invention.

Referring to FIG. 1, one embodiment of the invention will be illustrated. In FIG. 1, reversible counters for ascent and descent 1 to 3 have the data corresponded to floors and the data of the counter 1 are always set to be higher for one floor than the data of the counter 2.

When the ascent signal U is input to the counters 1 to 3, the data are increased to the values corresponding to the levels for one floor higher. When the descent signal D is input to the counters, the data are decreased to the values corresponding to the levels for one floor lower.

An output 3*a* of the counter 3 indicates a stoppable floor.

A selector 4 for counters sequentially selects one of the counters 1 to 3 by a selecting signal generated in a predetermined frequency. An absolute floor position memory 6 which permanently memorizes the selected floor as the distance from the reference position such as the lowest floor as address. A semiconductor type read only memory can be used for said purpose.

A selector 7 for registers sequentially outputs the data of the absolute floor position memory 6 under synchronizing to the selector 4 for counters by the selecting signal 5. The registers 8 to 10 are respectively corresponded to the counters 1 to 3 to store the data of the selector 7 for registers. When the counter 1 is selected by the selector 4 for counters, it is connected to input the data of the absolute floor position memory 6 corresponding to the output data of the counter 1 to the register 8. The registers 9, 10 have the same function of the register 8. A pulse encorder 11 is driven by governor sheave to output pulses being proportional to the distance of movement of the cage and to relatively detect the transit distance of the cage.

A direction discriminator 12 discriminates the ascent or descent of the cage by the pulses of the pulse encorder 11 and generates summing signal 12*a* in the ascent and subtracting signal 12*b* in the descent.

A present position detector 13 detects the present position of the cage by summing or subtracting the pulses of the pulse encorder, and is automatically preset to the distance from the reference position to the object floor in the lowest floor, the highest floor or the other desired floor.

An operator 14 operates difference between the data of the register 8 and the data of the present position detector 13 under comparing them.

An operator 15 operates difference between the data of the register 9 and the data of the present position detector 13. An operator 16 operates difference between the data given by operating the operators 14, 15 under comparing them. The summing inputs of the operators 14 to 16 are designated as (+) and the subtracting inputs are designated as (−).

Accordingly, the output of the operator 14 corresponds to the distance between the position of the cage and the floor for the counter 1.

A discriminator 17 discriminates positive or negative of the output of the operator 14, and outputs the signal when the output of the operator 14 is converted from positive to negative whereby the data of the counters 1, 2 are increased to the higher level for one floor.

A discriminator 18 corresponds to the operator 15 and generates the output when the output of the operator 15 is converted from positive to negative, whereby the data of the counters 1, 2 are decreased to the lower level for one floor.

A discriminator 19 corresponds to the operator 16 and outputs the signal depending upon positive or negative of the output of the operator 16. That is, the output of the operator 16 indicates whether the position of the cage is above or below the middle point of the floor indicated by the counter 1 and the counter 2, that is near which floor.

When the output of the operator 16 is positive, the position of the cage is near the floor indicated by the counter 2. When the output of the operator 16 is negative, the position of the cage is near the floor indicated by the counter 1.

A holding signal generator 20 generates the output when the output of the discriminators 17, 18 are input, and outputs a signal for holding it for a predetermined period (hereinafter referring to as holding signal).

A selector 21 for indicating counter selects the output of the counter 2 when the output of the discriminator is positive, and selects the output of the counter 1 when it is negative and outputs as floor indicating signal C. When the holding signal is not input, the data of the counter 1 or 2 is directly output to hold it.

When the holding signal is input, the data of the counter 1 or 2 at just before inputing the holding signal, are output under holding it during the period for inputing the holding signal.

A stop position operator 22 operates stoppable distance by the output of the present position detector 13 and the output of the register 10 which correspond to the present position of the cage, the absolute floor position and the speed command signal (not shown) whereby the stop position is decided in comparison with the operated result and the calling signal 23 for elevator.

The operation of the embodiment will be illustrated.

Tha data of the present position detector 13 are considered to be preset to zero at the lowest floor, and the cage is considered to stop at the third floor and the data of the counter 1 correspond to the fourth floor and the data of the counters 2 and 3 correspond to the third floor.

The outputs of the counters 1 and 2 are automatically set so as to include the position Si of the cage in the range of $Sh > Si \geqq Se$ wherein Sh and Se respectively designates the absolute floor positions corresponding to the outputs of the counters 1, 2 and Si designates the distance from the reference position of the output of the present position detector 13 to the position of the cage.

When the cage starts to rise, the pulses corresponding to the transit distance are output from the pulse encorder 11.

The direction discriminator 12 output the summing command 12*a* under discriminating as summing. In the present position detector 13, the pulses are added to increase the data. As the result, the data of the present position detector 13 always indicates the distance from the reference position to the cage.

On the other hand, the outputs of the counters 1, 2 are sequentially selected by the selector 4 for counters, and are input into the absolute floor position memory 6 whereby the absolute floor position memory 6 outputs the memorized data (absolute position) corresponding to the input (floor number). The output is registered in the register selected by the selector 7 for registers. As the result, the absolute position of the fourth floor is registered in the register 8 and the absolute position of the third floor is registered in the register 9.

The output of the present position detector 13 from starting the ascent from the third floor to reach to the fourth floor is more than the output of the register 9 and is less than the output of the register 8. Accordingly, until reaching to the middle point between the third floor and the fourth floor, the output of the operator 15 is less than the output of the operator 14 whereby the output of the operator 16 is positive and the discriminator 19 output the signal corresponding to positive.

The indicating selector 21 for counters select the counter 2 by the output whereby the indicating signal C corresponding to the third floor is output and the indication of the third floor is indicated by the signal C on the position indicators in riding places and the position indicator in the cage. (not shown). When the cage passes through the middle point between the third or fourth floors, the output of the operator 15 is more than the output of the operator 14, and the output of the operator 16 is negative whereby the discriminator 19 generates the output corresponding to negative.

The selector for indicating counters 21 selects the counter 1 to output the indicating signal C corresponding to the fourth floor to indicate the fourth floor.

When the cage rises to pass through the fourth floor, the output of the present position detector 13 becomes more than the output of the register 8, whereby the output of the operator 14 is converted from positive to negative. The discriminator 17 output the signal to increase the data of the counters 1 and 2 to higher level for one floor, respectively. The data of the counter 1 correspond to the fifth floor and the data of the counter 2 correspond to the fourth floor.

As the result, the output of the operator 15 becomes less than the output of the operator 14 whereby the output of the operator 16 is changed to positive and the discriminator 19 generates the output corresponding to positive.

The selector 21 for indicating counters selects the counter 2 by the output to hold the indication of the fourth floor.

In the description, when the data of the counters 1 and 2 are increased to the levels of the fifth floor and the fourth floor, respectively, the output of the discriminator 19 is not converted until discriminating as the result of the operation. Accordingly, there is a possibility to accidentally generate the indicating signal C for the fifth floor for a short period by the selector 21 for counters under selecting the counter 1. The holding signal generator 20 is to prevent the trouble, and synchronizes to the outputs of the discriminators 17, 18 to output the signals for a predetermined period (period for obtaining the result of the operation under the condition that the counters 1, 2 are newly set) thereby holding the value of the counter 2 selected at just prior to the starting the output of discriminators 17, 18. That is, the selector 21 for counters holds the indicating signal C for the fourth floor.

When the cage is descent from the third floor, the direction discriminator 12 generates the subtracting signal 12*b* whereby the present position detector 13 subtracts the pulses from the data thereof.

In result, the output of the operator 15 is immediately converted to negative to decrease the data of the counters 1, 2 to lower level for one floor.

The indication of the position of the cage is attained by the operation being opposite to those of the ascent operation.

Thus, the indication of the next floor can be attained for each time passing the cage through each of middle points.

On the other hand, when the cage stay at the third floor, the data of the counter 3 correspond to the third floor. The data are stored through the selector 4 for counters, the absolute floor position memory 6 and the selector 7 for registers into the register 10, as same with the abovementioned operation.

The stop position operator 22 output by the ascent of the cage, whereby the data of the counter 3 increase to the level for the fourth floor and the data of the register 10 increase to the level for the fourth floor. When the calling signal 23 for the fourth floor is not input, the stop position operator 22 generates the output to convert the data of the counter 3 to the level for the fifth floor. When the calling signal for the fifth floor is detected, the stop command signal (not shown) is output to stop the cage at the fifth floor if it is stoppable under the comparison of the stoppable distance decided by the provisional operation.

The output 3*a* of the counter 3 indicates forward position signal for indicating the stoppable floor. Accordingly, the output 3*a* can be used for detecting the calling signal and indicating the stoppable floor.

Figure 2:
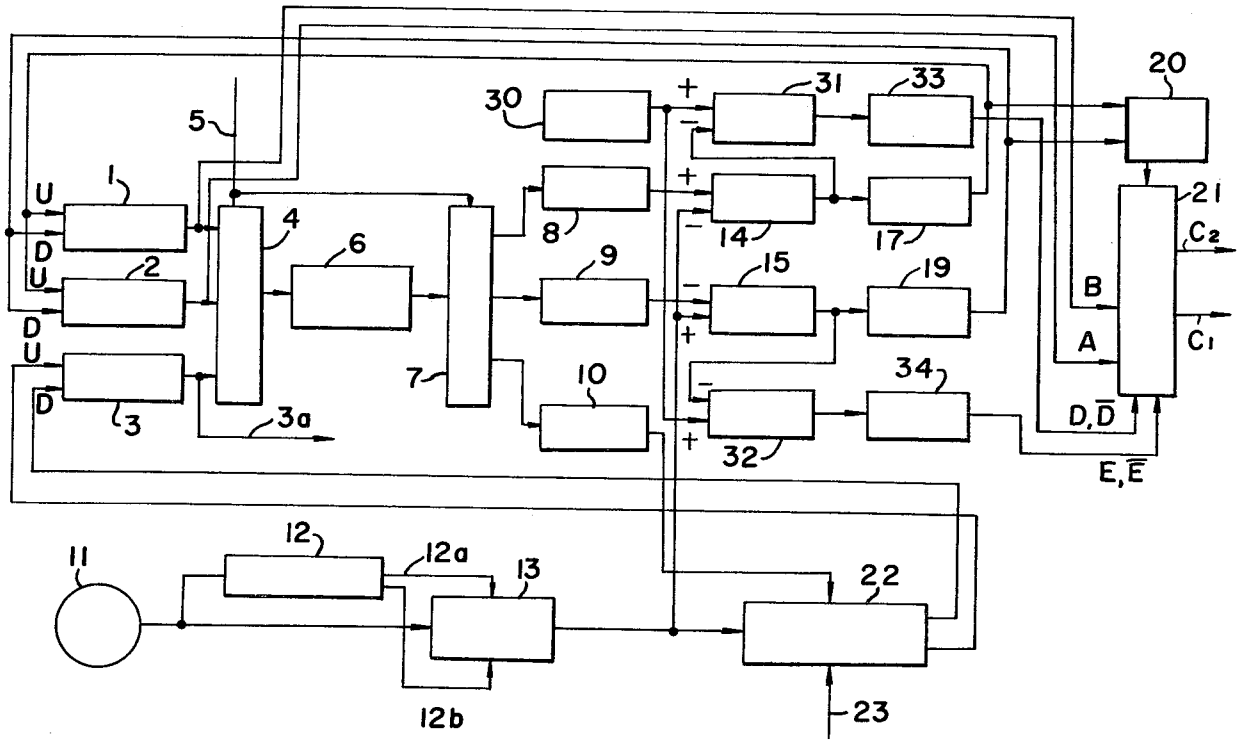
FIG. 2 is a block diagram of the other embodiment according to the invention.
Figure 3:
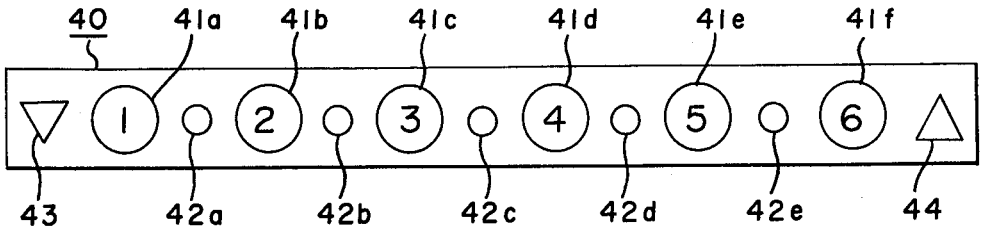
FIG. 3 is a plan view of a position-indicator used for the embodiment of FIG. 2.

FIGS. 2 and 3 show the other embodiments of the invention.

In FIGS. 2 and 3, a register 30 memorizes the distance for floor zone. When $\pm l^{mm}$ from the center of the floor position is given as the floor zone, the register 30 memorizes the data of the distance corresponding to $l^{mm}$, wherein $l$ is shorter than one-half of the minimum gap between the floors.

An operator 31 operates the difference between the data of the register 30 and the data of the operator 14 under comparing them. An operator 32 operates the difference between the data of the register 30 and the data of the operator 15.

A discriminator 33 discriminates positive or negative of the output of the operator 31 to generate the output. A discriminator 34 discriminates positive or negative of the output of the operator 32.

The references $C_1$, $C_2$ designate outputs of the indicating selector for counters and $C_1$ designates a floor indicating signal and $C_2$ designates a floor interposition indicating signal.

In FIG. 3, a position indicator 40 is disposed in the cage or the riding position. Floor indicating lamps 41*a* to 41*f* respectively turned on by the floor indicating signal C of FIG. 1 when the cage is at the floor position of the first to sixth floors. Floor interposition indicating lamps 42*a* to 42*e* are respectively turned on by the floor interposition indicating signal $C_2$ when the cage is at the floor interposition such as between first and second floors;

between second and third floors; . . . .

Direction indicating lamps 43, 44 are respectively turned on to indicate the direction of driving the cage for up and down.

The other structures are similar to those of FIG. 1.

The logical equation for showing the selecting conditions of the selector 21 is given as follows.

$$C = A \cdot D + B \cdot \overline{D} \quad (1)$$

wherein $A$ and $B$ respectively designate the inputs of the counters 2, 1 and $C$ designates the output and D, $\overline{D}$ respectively designate selecting conditions.

The selecting conditions D, $\overline{D}$ are respectively input from the discriminator 19 wherein it is D in the case of positive output of the operator 16 and it is $\overline{D}$ in the case of negative of the operator 16.

The selecting conditions in the embodiment of FIG. 2 can be given by the following equations.

$$C_1 = A \cdot E + B \cdot D \quad (2)$$

$$C_2 = A \cdot \overline{D} \cdot \overline{E} \quad (3)$$

wherein A, B respectively designate the inputs of the counters 2, 1 and $C_1$, $C_2$ respectively the outputs of the counters and D, $\overline{D}$ respectively designate the selecting conditions.

The selecting conditions D, $\overline{D}$ are respectively inputs from the discriminator 33 wherein it is D in the case of positive output of the operator 33 and it is $\overline{D}$ in the case of negative output of the operator 33. The selecting conditions E, $\overline{E}$ are respectively inputs from the discriminator 34 wherein it is E in the case of positive output and it is $\overline{E}$ in the case of negative output.

Figure 4:
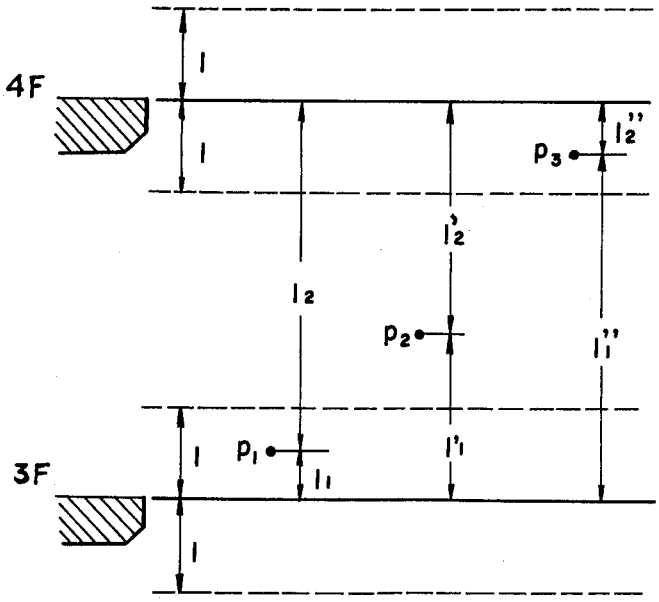
FIG. 4 is a schematic view for illustrating a relation of the position of cage and the output of an operator.

When the cage is ascent from the third floor, the absolute position of the third floor is registered in the register 9 and the absolute position of the fourth floor is registered in the register 8 and the distance $l$ is memorized in the register 30. When the cage starts to rise, the output of the operator 15, corresponds to the distance $l_1$ from the third floor position to the cage position $p_1$ and the output of the operator 32 corresponds to $l - l_1 > o$, as shown in FIG. 4. Accordingly, the output of the operator 32 is positive until reaching the difference between the output of the detector 13 and the output of the register 9 to the value corresponding to $l$, that is until reaching to the position of $l^{mm}$ from the third floor.

The selecting condition E in the logical equations (2), (3) is given to the selector 21 by the output of the discriminator 34.

On the other hand, the output of the operator 14 corresponds to the distance $l_2$ from the position of the cage $p_1$ to the fourth floor. The output of the operator 31 corresponds to $l - l_2 < o$. Accordingly, the output of the operator 33 is negative and the selecting condition is $\overline{D}$. Accordingly, the input A from the counter 2 is selected from the logical equations (2), (3) to give the output $C_1$ to turn on the indicating lamp 41*c* at the third floor in the position indicator 40. The output $C_2$ is not given. When the cage rises at higher than $l^{mm}$ from the third floor, and reaches the position $p_2$ of FIG. 4, the output of the operator 32 corresponds to $l - l'_1 < o$. The selecting condition $\overline{E}$ in the logical equations (2), (3) is given to the selector 21 by the output of the discriminator 34.

On the other hand, the output of the operator (31) still corresponds to $l - l'_2 < o$ and the selecting condition is $\overline{D}$. Accordingly, the input A from the counter 2 is selected in the logical equations (2), (3) and it is converted to the output $C_2$ to turn on the floor interposition indicating lamp 42*c*. The output $C_1$ is not given.

When the cage rises further to reach the position within $l^{mm}$ from the fourth floor, and reaches the position $p_3$ of FIG. 4, the output of the operator 31 corresponds to $l - l''_1 > o$.

The selecting condition D is given to the selector 21 by the output of the discriminator 33.

On the other hand, the output of the operator 32 corresponds to $l - l''_2 < o$, and the selecting condition is $\overline{E}$.

Accordingly, the input B is selected and it is converted to the output $C_1$ to turn on the indicating lamp 41*d* for the fourth floor.

The output $C_2$ is not given.

When the cage passed through the fourth floor, as it is clear from the description on FIG. 1, the data of the counter 1 correspond to the fifth floor and the data of the counter 2 correspond to the fourth floor.

The operation are similar to those of the above-mentioned operations to sequentially turn on the interposition indicating lamp 42*d*, the indicating lamp 41*e* for the fifth floor, . . . .

Thus, when the cage is positioned in the floor zone, the floor is indicated. When the cage is passed through the floor zone, the floor interposition indication is attained.

Accordingly, the position of the cage can be indicated to riders and also to the administrator, the engineer in accident, in higher accuracy in comparison with those of the conventional equipments.

As stated above, in accordance with the invention, the difference between the present position which is relatively detected from the transit distance of the cage and the absolute floor position from the reference position to the floor are compared and operated to output the indicating signal for the cage position, whereby no mechanical part is used, the indication of the cage position can be attained for a long period in high accuracy with the miniaturized equipment.

Figure 7:
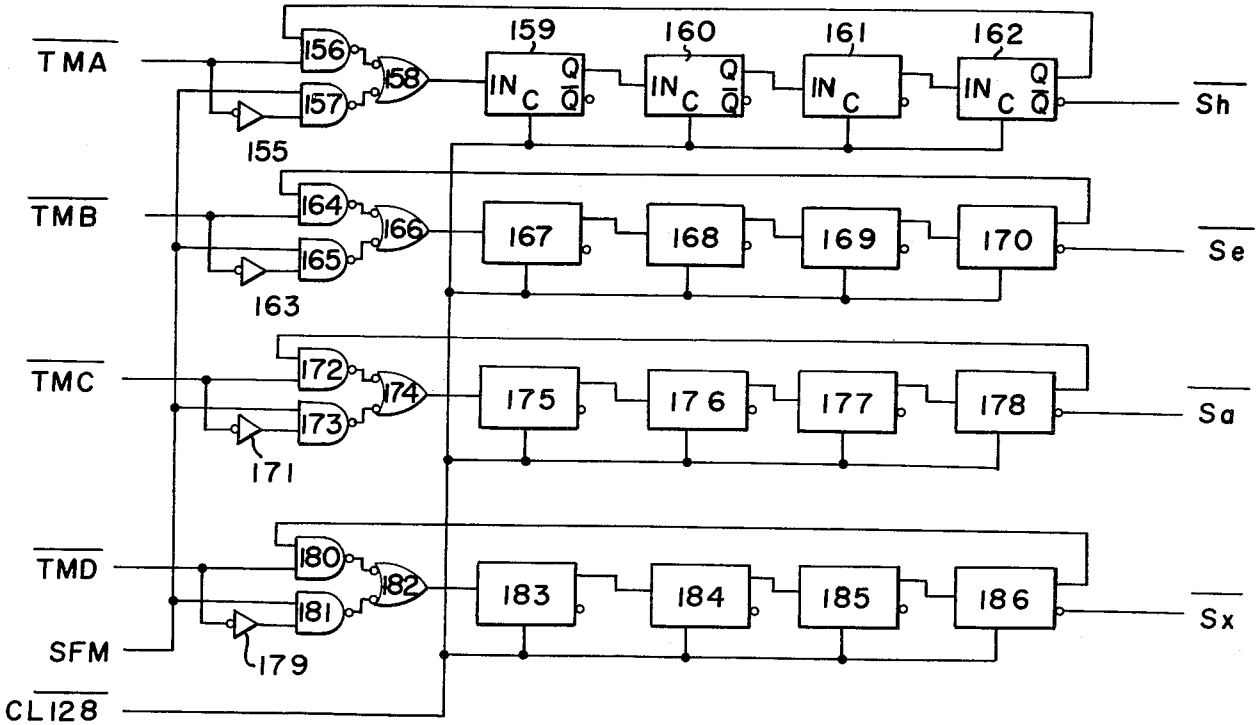
Figure 8:
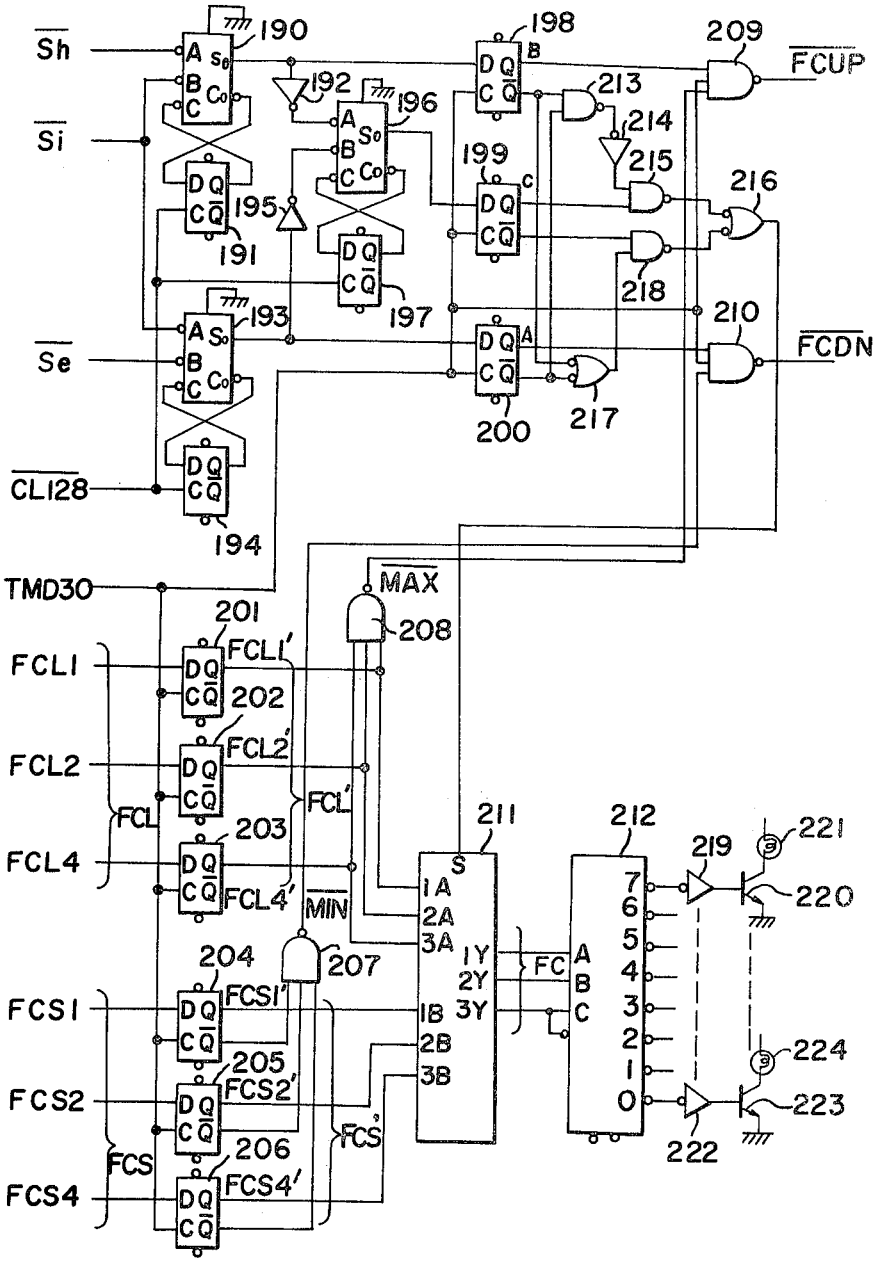
Figure 9:
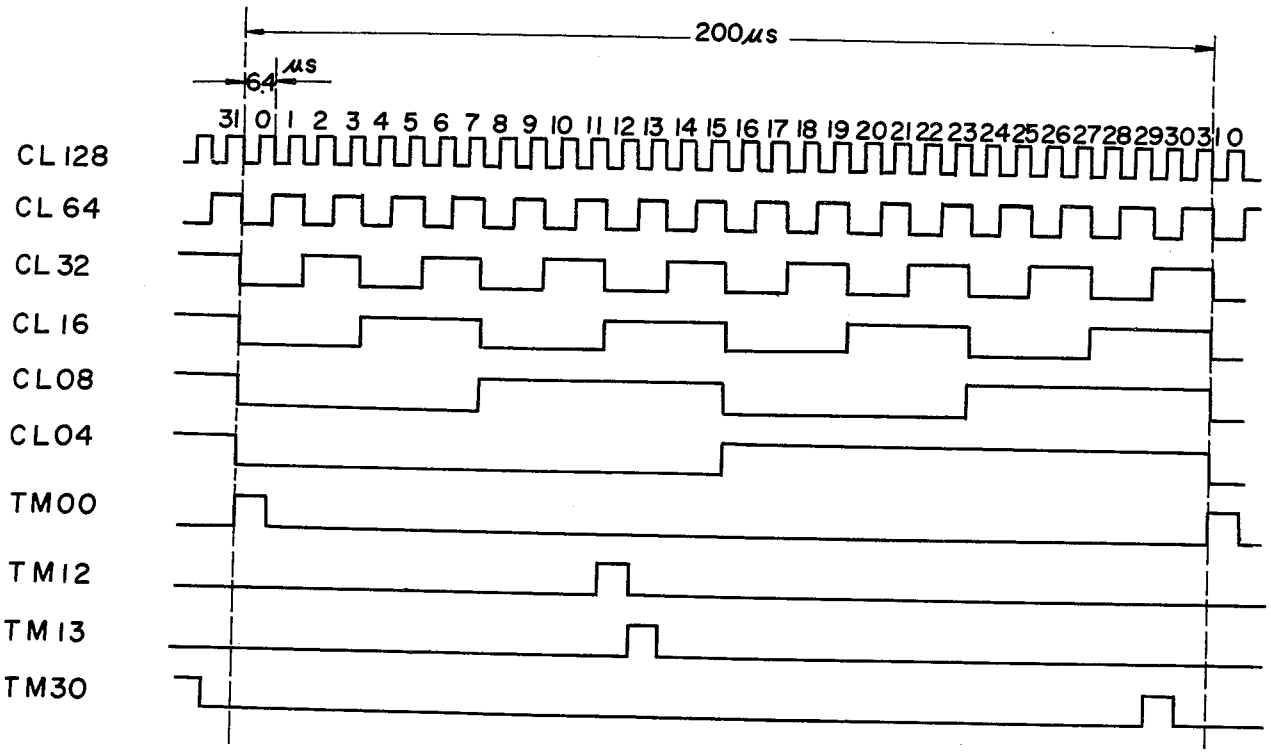
FIGS. 9 and 10 are timing charts for illustrating FIGS. 5 to 8.
Figure 10:
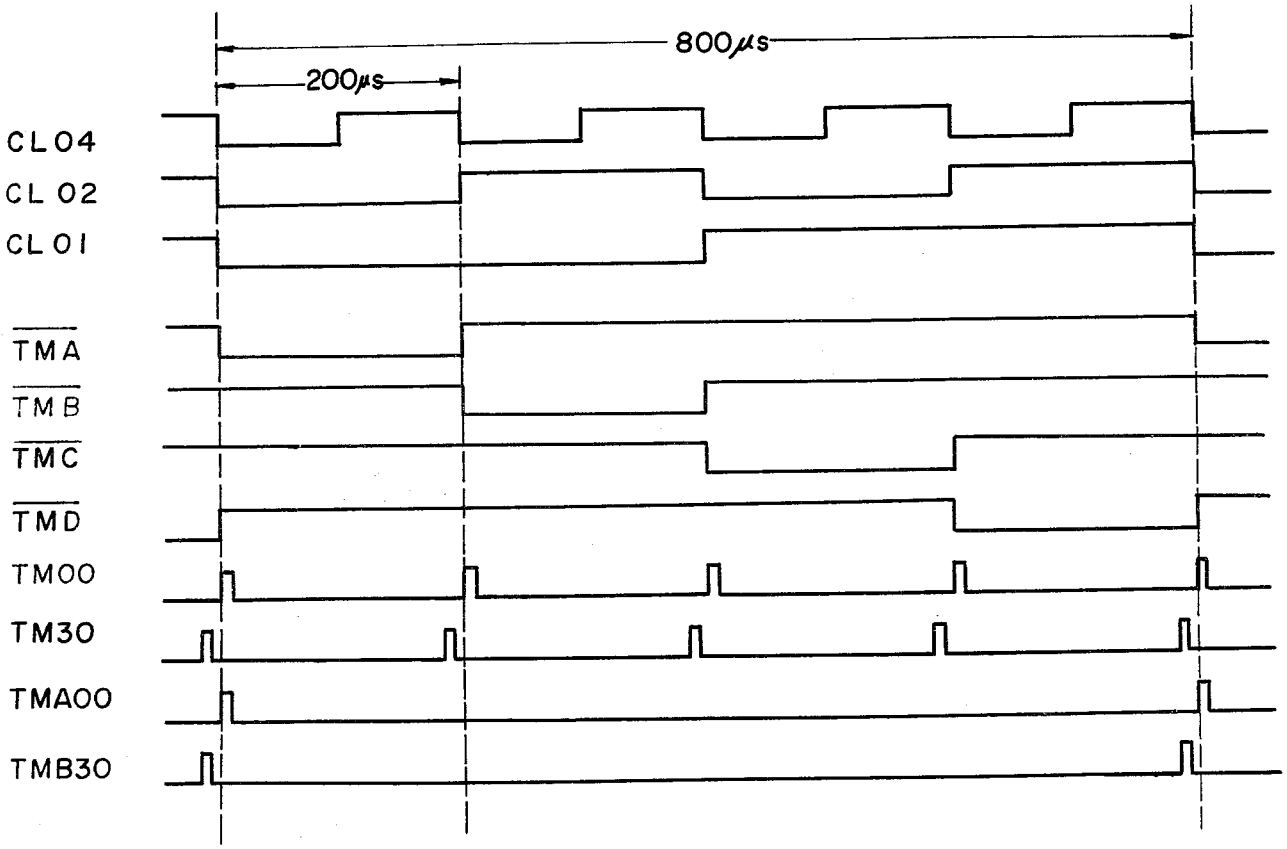

The embodiments of the invention will be further illustrated referring to FIGS. 5 to 8 with the timing charts of FIGS. 9 and 10.

FIG. 9 is a timing chart of the basic operation clock and timing signals during one fundamental operating period.

The fundamental operating period corresponds to 200 $\mu$ seconds for 32 cycles of the basic operation clock CL128 having 125 KHz.

The clocks CL64, CL32, CL16, CL08 and CL04 are given by respectively frequency-dividing the basic operation clock into $\frac{1}{2}$, $\frac{1}{4}$, $\frac{1}{8}$, 1/16 and 1/32.

The one period of the clock CL04 is equal to the fundamental operating period.

The timing signals TM00, TM12, TM13 and TM30 have particular timely positions in the fundamental operating period, and are given by the clocks CL64, CL32, CL16, CL08 and CL04 under the following logical states.

$$TM00 = \overline{CL64} \cdot \overline{CL32} \cdot \overline{CL16} \cdot \overline{CL08} \cdot \overline{CL04}$$

$$TM12 = \overline{CL64} \cdot \overline{CL32} \cdot CL16 \cdot CL08 \cdot \overline{CL04}$$

$$TM13 = CL64 \cdot \overline{CL32} \cdot CL16 \cdot CL08 \cdot \overline{CL04}$$

$$TM30 = \overline{CL64} \cdot CL32 \cdot CL16 \cdot CL08 \cdot CL04.$$

The fundamental operating period consists of 32 of time slots having 6.25 $\mu$ seconds.

The timely positions in the fundamental operating period are referred by numerals of 0 to 31 so that the position of the timing signal TM00 is referred as the position of the time slot 0, and the position of the timing signal TM13 is referred as the position of the timing slot 13.

FIG. 10 is a timing chart for showing the operating period of the embodiment of the invention.

The operating period is for 4 of the fundamental operating periods and corresponds to 800 $\mu$ seconds.

The clocks CL02 and CL01 are respectively given by frequency-dividing the clock CL04 into $\frac{1}{2}$ and $\frac{1}{4}$.

The timing signals TMA, TMB, TMC and TMD are respectively "0" in the first fundamental operating period, the second fundamental operating period, the third fundamental operating period and the fourth fundamental operating period in the operating period, and are respectively given by the clocks CL02 and CL01 under the following logical states.

$$\overline{TMA} = \overline{CL02} \cdot \overline{CL01}$$

$$\overline{TMB} = CL02 \cdot \overline{CL01}$$

$$\overline{TMC} = \overline{CL02} \cdot CL01$$

$$\overline{TMD} = CL02 \cdot CL01.$$

The timing signals TMA00 and TMD30 respectively have the period of 800 $\mu$ seconds which is equal to the operating period and is given under the following logical states to have the particular timely position in the operating period.

$$TMA00 = TMA \cdot TM00$$

$$TMD30 = TMD \cdot TM30.$$

Figure 5:
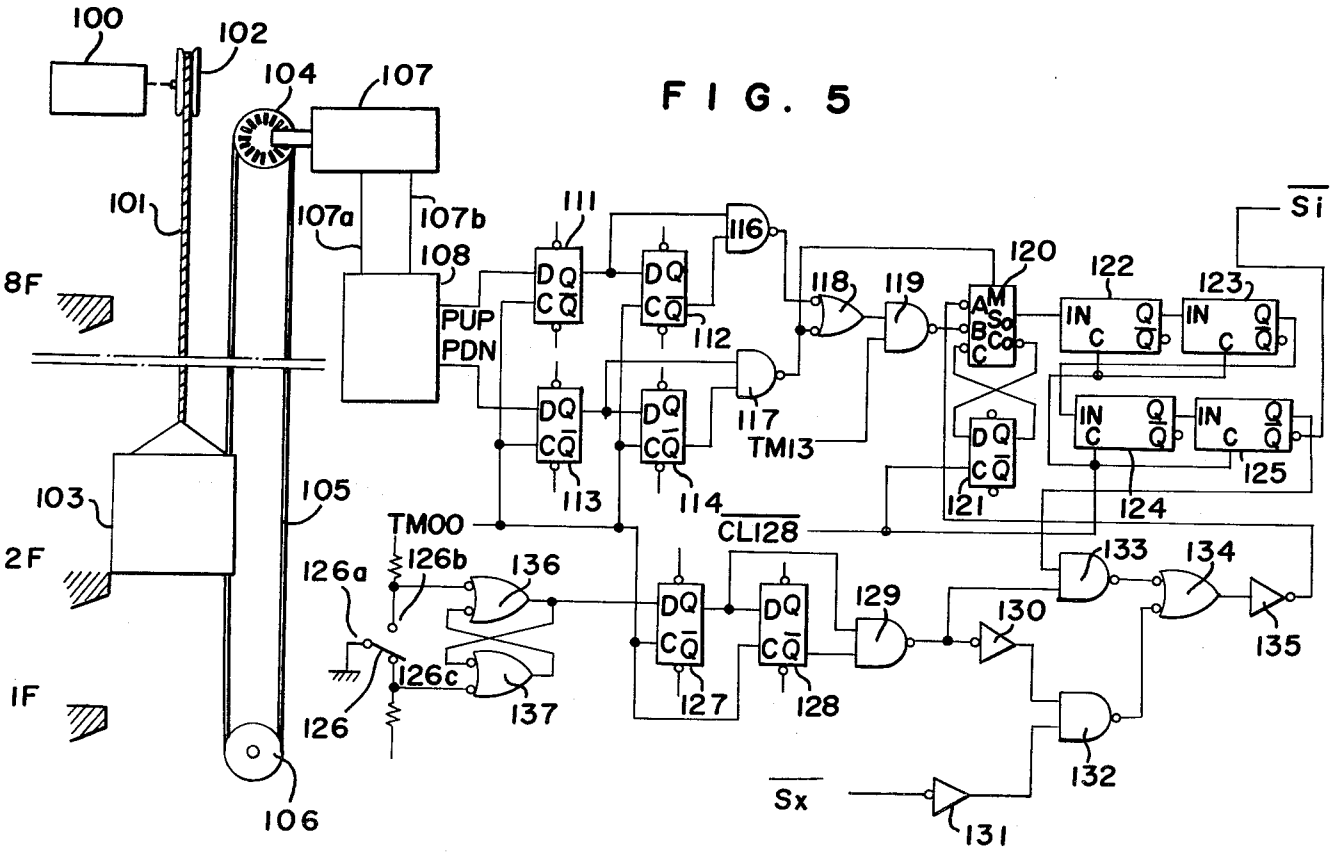
FIG. 5 is a schematic view of the position detecting mechanism and a circuit diagram of the present position detector.

FIG. 5 is a schematic view of the position detecting mechanism and a circuit diagram of the present position detector.

In FIG. 5, a cage 103 is supported by a rope 101 which is reeved over a traction sleave 102 mounted on the shaft of a drive motor 100, such as a direct current motor as used in the Ward-Leonard drive system. A governor rope 105, which is connected to the top and bottom of the cage 103, is reeved over a governor sheave 104 located above the highest point of travel of the cage in the hatchway, and a pulley 106 located at the bottom of the hatchway.

A pulse generator 107 is dirven by the governor sheave 104 to generate pulses **107*a*, 107*b*** which have 90° shifted phases.

A direction discriminator 108 receives the pulses **107*a*, 107*b* generated by the pulse generator 107 and discriminates the direction of the cage whereby the upper pulse signal PUP synchronized to either the pulse 107*a* or 107*b* is generated at the ascent of the cage and the down pulse signal PDN synchronized to the other pulse 107*b* or 107*a*** is generated at the descent of the cage.

The upper pulse signal PUP is converted to the pulse having length for one period of the timing TM00 by flip-flops 111, 112 and a gate 116 and is input through a gate 118 to enable a gate 119 to pass a timing TM13. The down pulse signal PDN is also converted to the pulse having length for one period of the timing TM00 by flip-flops 113, 114 and a gate 117 and is input through a gate 118 to enable a gate 119 to pass the time TM13. One pulse of the upper pulse or the down pulse, is converted to the pulse synchronized to the timing TM13.

A binary full adder/subtractor 120 which has two operating modes is for adding when its input terminal M is "1" and is for subtracting when its input terminal M is "0".

The binary full adder/subtractor 120, 8 bit shift registers 122, 123, 124, 125 and a flip-flop 121 is connected.

The carrier output terminal $C_o$ of the binary full adder/subtractor 120 is connected to the input terminal D of the flip-flop 121. The carrier input terminal C of the binary full adder subtractor 120 is connected to the output terminal Q of the flip-flop 121. The carrier output is delayed for one clock by the basic operation clock to feedback to the carrier input terminal C of the binary full adder subtractor 120.

The output terminal $S_o$ of the binary full adder subtractor 120 is connected to the input terminal IN of the shift register 122.

The output terminal Q of a shift register 125 is connected through gates 133, 134 and an inverter 135 to the input terminal A of the operator 120. Accordingly, the binary full adder subtracter 120, the shift registers 122, 123, 124, 125 and the flip-flop 122 form the 32 bit series operation circuit. When the cage starts to rise, the pulse synchronizing to the timing TM13 is input to the sum input B of the binary full adder subtractor 120 at a rate of one per one count-up pulse signal PUP.

The summing operation of the binary full adder subtractor 120 gives the unit transit distance at the position corresponding to the timing signal TM13 in the operating period (a position of time slot 13). The position pulses are stored in binary system.

Figure 6:
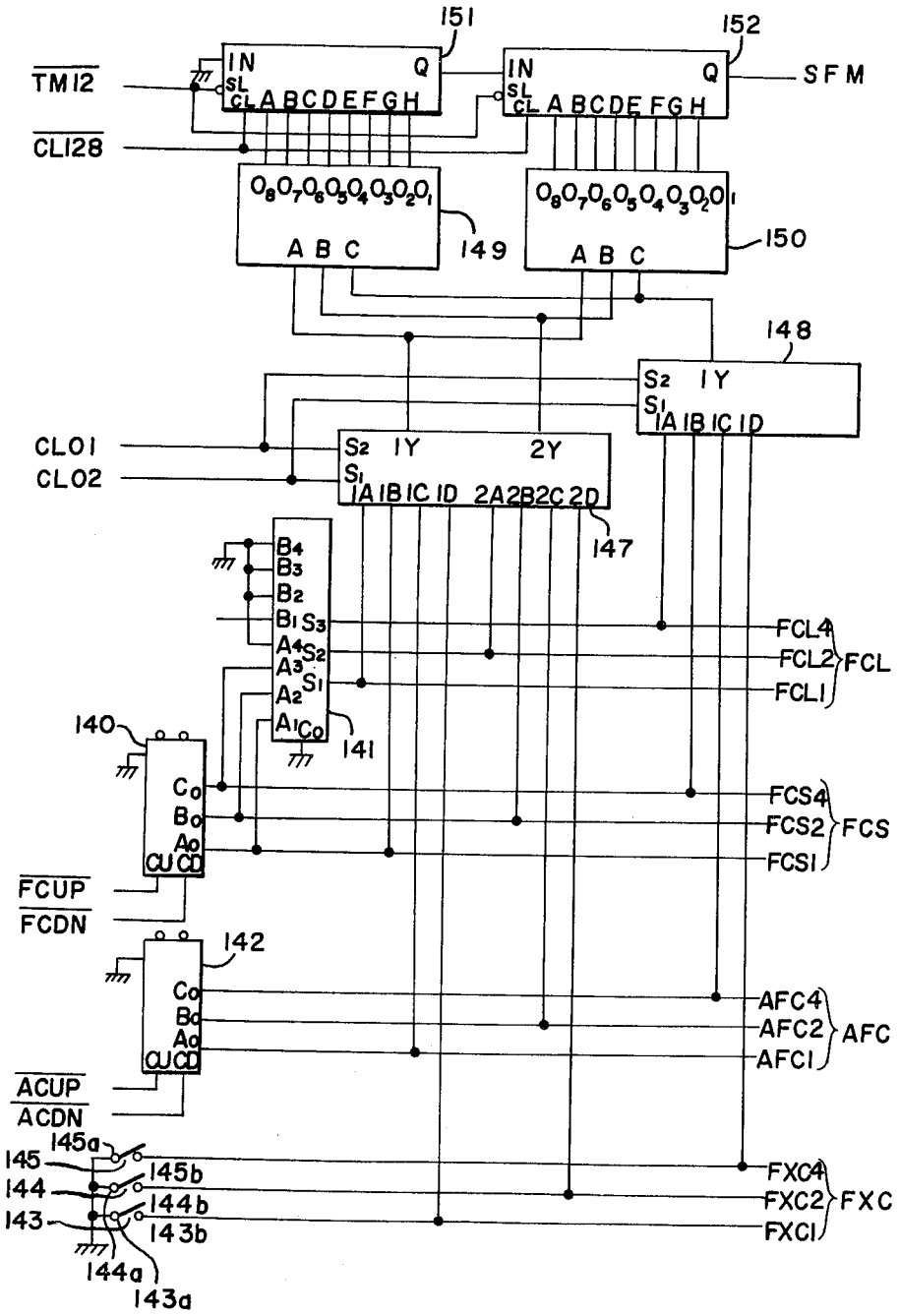
FIGS. 6 to 8 are circuit diagrams of the main operating units from a counter 1 to a selector 21 shown in FIG. 1.

When the data of the shift register are reset at the reference position such as the lowest floor, the present position indicating signal $\overline{Si}$ which indicate the position of the cage in the series binary system by the output $\overline{Q}$ of the shift registers after the time slot 13 in the 32 bit basic operating period. FIGS. 6, 7 and 8 are circuit diagrams of the main operating units from the counter 1 to the selector for indicating counter 21 shown in FIG. 1. The circuits for eight floors will be illustrated for ready understanding.

In FIG. 8, an up-down counter 140 has output terminals A, B, C, D and count-up input terminal CU and count-down input terminal CD and count data in binary 4 bits. The count-up signal $\overline{FCUP}$ is input to the count-up input terminal CU. The count-down signal $\overline{FCDN}$ is input to the count-down input terminal CD whereby the floor signals FCS in binary 3 bits (FCS1, FCS2, FCS4) corresponding to the floors in first to eighth floor, are output. In a 4 bit parallel adder 141, the outputs FCS1, FCS2, and FCS4 of the up-down counter 140 are respectively input to the input terminals $A_1$, $A_2$ and $A_3$. The input terminal $A_4$ is in "0" level.

In the input terminals $B_1$, $B_2$, $B_3$ and $B_4$, $B_1$ is in "1" level and $B_2$, $B_3$ and $B_4$ are in "0" level so as to give "1" in binary.

Accordingly, the floor signals in binary 3 bits FCL1, FCL2 and FCL4 are respectively input to the output terminals $S_1$, $S_2$ and $S_3$. The datum correspond to the floor signal FCL which is higher than the output signal FSC of the up-down counter 140 for 1 count. That is, the floor signal FCL is the output of the counter 1 of FIG. 1, and the signal FCS of the up-down counter 140 is the output of the counter 2. Hereinafter, FCL is referred as upper floor signal and FCS is referred as lower floor signal.

A 4 bit up-down counter 142 is similar to the up-down counter 140 and corresponds to the counter 3.

The outputs of the stop position operator 22, i.e. count-up signal $\overline{ACUP}$, count-down signal $\overline{ACDN}$ are input to output the cage stoppable floor signal AFC in binary 3 bits i.e. AFC1, AFC2 and AFC4.

In switches 143, 144, 145, the contacts 143*a*, 143*b*, 144*a*, 144*b*, 145*a*, 145*b* are turned on or off to set the three bit signals FXC1, FXC2, FXC4 for the setting floor signal FXC.

A circuit 147 has two data selectors for selecting one signal from the four signals.

The signals FCL1, FCS1, AFC1 and FXC1 are respectively input to the four input terminals 1A, 1B, 1C and 1D and the signals FCL2, FCS2, AFC2 and FXC2 are respectively input to the terminals 2A, 2B, 2C and 2D.

The clock signals CL02 and CL01 are respectively input to the selecting input terminals $S_1$ and $S_2$.

From the input terminals 1Y, and 2Y, the signals FCL1 and FCL2 are respectively output in the first basic period and the signals FCS1 and FCS2 are respectively output in the second basic period and the signals AFC1 and AFC2 are respectively output in the third basic period and the signals FXC1 and FXC2 are respectively output in the fourth basic period. Data selectors 148 and 147 also respectively select one signal from the four signals. The signals FCL4, FCS4, AFC4 and FXC4 are respectively input to the terminals 1A, 1B, 1C and 1D. The signals FCL4, FCS4, AFC4 and FXC4 are sequentially output from the output terminal 1Y in the first to fourth basic period.

The circuit for the selector 4 for counters of FIG. 1 is formed by the data selectors 147 and 148.

The upper floor signal FCL, the lower floor signal FCS, the cage stoppable floor signal AFC and the setting floor signal FCX are sequentially output in the four basic operating periods.

Memories for read-out 149, 150 have structure of 8 bits 32 words. In the embodiment, 8 words (32/4) are used as the stopping floors are 8. The absolute distances from the reference position (e.g. lowest floor) are memorized.

The floor positions are memorized in binary 16 bits as one pulse generated from the position pulse generator of FIG. 5 for the unit distance.

The absolute distances from the reference position to the floors corresponding to the 3 bit floor signals of the outputs of the data selectors 147, 148 which are connected to the address input terminals A, B and C of the memories 149, 150 (the absolute distances are shown by the unit distances) are given by the 16 bit outputs which include 8 bit outputs from $O_1$ to $O_8$ of the memory 149 and 8 bit outputs from $O_1$ to $O_8$ of the memory 150.

In 8 bit shift registers 151 and 152 which have 8 bit parallel preset input terminals A, B, C, D, E, F, G and H, the series input terminal IN of the shift register 151 is set to "0" and the output terminal Q is connected to the series input terminal IN of the next shift register 152. The timing signal $\overline{TM12}$ is fed to the preset load terminal SL and the 16 bit floor position signals of the outputs of the memories for read-out 149, 150 are preset.

Accordingly, the absolute floor position memory 6 is formed by the memories for read-out 149, 150 and the shift register 151, 152.

The circuit of FIG. 7 will be illustrated.

In 8 bit shift registers 159, 160, 161, 162, the output terminals respectively are connected to the input terminals of the next shift register whereby 32 bit shift registers for the basic operating period is formed. In the first basic period, the timing signal $\overline{TMA}$ is passed through an inverter 155 to enable a gate 157, and the series floor position signal SFM is passed through gates 157, 158 to input to the shift registers 159, 160, 161, 162. In the other three basic periods, the timing signal $\overline{TMA}$ is "1" whereby the gate 157 is disabled and the gate 156 is enabled and the signal SFM is repeatedly input to memorize the signal SFM in the shift registers 159, 160, 161, 162.

In the first basic period, the upper floor signal FCL s input in the input addresses of the memories for read-out 149, 150 whereby the series upper floor position signal $\overline{Sh}$ is always output from the output terminal $\overline{Q}$ of the shift register 162.

In the second basic period, the series floor position signal SFM corresponding to the lower floor signal FCS is input through the gates in the shift registers 167, 168, 169, 170, by the timing signal $\overline{TMB}$. The series lower floor position signal $\overline{Se}$ is input to the output terminal $\overline{Q}$ of the shift register 170.

In the third basic period, the series floor position signal SFM corresponding to the stoppable floor signal AFC is input through gates 173, 174, in the shift registers 175, 176, 177, 178 by the timing signal $\overline{TMC}$.

The series stoppable floor signal $\overline{Sa}$ is input to the output terminal $\overline{Q}$ of the shift register 178.

In the fourth basic period, the series floor position signal SFM corresponding to the setting floor signal FXC is input through gates 181, 182 in the shift registers 183, 184, 185, 186 by the timing signal $\overline{TMD}$.

The series setting floor position signal $\overline{Sx}$ is output to the output terminal $\overline{Q}$ of the shift register 186.

The circuit of FIG. 8 will be illustrated.

A binary full adder/subtractor 190 has a sum input terminal A, a subtraction input terminal B, a carrier input terminal C, a subtraction output terminal S*o* and a carrier output terminal $C_o$. The carrier output terminal $C_o$ is connected to the input terminal D of a flip-flop 191 and the carrier input terminal C is connected to the output terminal Q of the flip-flop 191. The carrier output signal $C_o$ is input to the carrier input terminal C in the delay for 1 clock by the basic operation clock $\overline{CL128}$, whereby the binary full adder/subtractor 190 and the flip-flop 191 used as the series subtracting operator.

A binary full adder/subtractor 193 and a flip-flop 194 are also used as the series subtracting operator and a binary full adder/subtractor 196 and a flip-flop 197 are also used as the series subtracting operator.

In the binary full adder/subtractor 190, the series upper floor position signal $\overline{Sh}$ is input to the sum input terminal A, and the present position signal $\overline{Si}$ is input to the subtraction input terminal B, and the distant difference signal Δ S*h* is output from the output terminal $S_o$.

The positive or negative of Δ S*h* is discriminated. When S*h* < S*i*, the output terminal Q of the flip-flop 198 is in "1".

In the binary full adder/subtractor 193, the present position signal $\overline{Si}$ is input to the sum input terminal A, and the series lower floor position signal $\overline{Se}$ is input to the subtraction input terminal B and the distant difference signal Δ S*e* is input to the input terminal D of a flip-flop 200, and the positive or negative of Δ S*e* is discriminated by the timing signal TMD30. When S*i* < S*e*, the output terminal Q of the flip-flop 200 is in "1".

In the binary full adder/subtractor 196, the subtraction of Δ S*h* and Δ S*e* is operated. The positive or negative is discriminated by the timing signal TMD30 in the flip-flop 199.

When Δ S*h* < Δ S*e*, that is the cage is present at higher than the middle point between the upper floor and the lower floor, the output Q of the flip-flop 199 is "1".

A group of flip-flops 201, 202, 203, 204, 205, 206 hold the upper floor signals FCL of FCL1, FCL2 and FCL3 and the lower floor signals FCS of FCS1, FCS2 and FCS4.

The holding signal generator 20 of FIG. 1 is formed by the flip-flops 201, 202, 203, 204, 205, 206, wherein the signals FCL and FCS are synchronized to the timing signal TMD30 whereby synchro upper floor signal FCL'. and synchro lower floor signal FCS' are respectively output.

A data selector 211 is to select the parallel signals. The signals FCL' of FCL1', FCL2' and FCL4' are respectively input to one 3 bit input terminals 1A, 2A and 3A.

The signals FCS' of FCS1', FCS2' and FCS4' are respectively input to the other 3 bit input terminals 1B, 2B and 3B. When the selected input S is "0", the signal FCS' are output to output terminals 1Y, 2Y and 3Y. When the selected input S is "1", the signal FCL' are output.

When the signals FCS' are "0", (the lowest floor), the outputs ($\overline{Q}$) of flip-flops 204, 205, 206 are respectively "1". Accordingly, outputs of a 3 input NAND gate 207 are "0", whereby the lowest floor signal $\overline{MIN}$ is output to disable a gate 201 and the count-down signal $\overline{FCDN}$ for count-down of the floor counter 140 is blocked.

When the signals FCL' are "1", (highest floor), outputs of a 3 input NAND gate 208 are "0", whereby the highest floor signal $\overline{MAX}$ is output to disable a gate 209 and the count-up signal $\overline{FCUP}$ for count-up of the floor counter 140 is blocked.

When the present position S*i* of the cage is higher than the upper floor position S*h*, the output Q of the flip-flop (198) is "1".

When the signal $\overline{MAX}$ is not "1", (no highest floor), the gate 209 is enabled to pass the clock signal TMD30 whereby the count-up signal $\overline{FCUP}$ for count-up of the floor counter 140 is output.

When the present position Si of the cage is lower than the lower floor position S*e*, the output (Q) of the flip-flop (200) is "1". When the signal $\overline{MIN}$ is not "1", (no lowest floor), the gate 210 is enabled to pass the clock signal TMD30 whereby the count-down signal $\overline{FCDN}$ for count-down of the floor counter 140 is output.

What is claimed is:

1. A position-indicating signal equipment for an elevator cage is an elevator system for detecting the position by generating pulses depending upon the distance and direction of the elevator cage and by counting the pulses comprising:

a position-pulse generator for generating pulses depending upon the movement of the cage;

a present position detector for detecting the present position of the cage by counting the output pulses of the position-pulse generator;

a floor position read only memory which memorizes floor position signals as data signals of a binary number calculated by providing a binary number for each floor as each address and calculating the absolute distance from the reference position to the floor to the number of output pulses of the position pulse generator;

a plurality of floor position registers for storing the floor position signals;

a plurality of floor indicators for outputing the floor numbers;

a time dividing selector which time-division selects the output of the floor indictors as the addresses of the floor position read only memory and sequentially allots the output of the floor position read only memory to the floor position registers;

a selector indicator for selecting the outputs of the floor number indicators; and an arithmetic unit for comparing the output of the present position detectors and the output of the floor position registers to generate an output of the result of operation to the floor indicators and the selector indicator;

whereby a signal for indicating the cage position is obtained as the output of the selector indicator.

2. A position-indicating signal equipment according to claim 1 comprising:

a position-pulse generator;

a present position detector for counting the output pulses of the position-pulse generator and for outputing the pulses of the position-pulse generator for the distance from the rated position to the position of the cage;

a floor position read only memory;

a first counter for outputing the floor number;

a second counter for outputing the floor number for one floor above that of the first counter;

a first selector for alternatively time division selecting the outputs of the first and second counters as the addresses of the floor position read only memory;

a first floor position register for storing the data of the access floor positions of the floor position read only memory as the addresses of outputs of the first counter;

a second floor position register for storing the data of the access floor positions of the floor position read only memory as the addresses of outputs of the second counter;

a second selector for time division alternatively allotting the output of the floor position read only memory to the first floor position register and the second floor position register under synchronization with the first selector;

an operation circuit for controlling the first counter and the second counter so as to generate the output value of the present position register between the outputs of the first floor position register and the second floor position register;

a third selector for selecting the output of the first counter if the output of the present position register approximates the output of the first floor position register and for selecting the output of the second counter if the output of the present position register approximates the output of the second floor position register;

whereby the floor number selected by the third selector is output as the signal for the nearest floor.

3. A position-indicating signal equipment according to claim 2 comprising:

a distance constant register for storing the data of a predetermined distance as pulse numbers;

an adder for summing the output of the first floor register and the output of the distance constant register;

a subtractor for subtracting the output of the distance constant register from the output of the second floor register;

a discriminator for indicating a position signal which outputs a block command of the cage position indicating signal as the output of the third selector when the output of the present position register is between the output of the adder and the output of the subtractor;

whereby the cage position indicating lamps are not turned on in the predetermined floor zone.

4. A position-indicating signal equipment according to claim 2 comprising:

a third counter for outputing the data of the floor for stopping the cage;

a fourth selector similar to the first selector which alternatively time division selects the outputs of the first, second and third counters as the addresses of the floor position read only memory;

a third position register for storing the floor positions of the access floor position read only memory as the address of the output of the third counter;

a fifth selector similar to the second selector which alternatively time division allots the output of the floor position read only memory to the first, second and third floor position registers under synchronization with the fourth selector;

a stop position operation circuit for operating the stoppable position of the cage; and a stop deciding circuit for generating a stop command at the time the output of the third floor register coincides with the output of the stop position operation circuit.

5. A position-indicating signal equipment according to claim 2 comprising:

switches for setting discretional floor numbers as a binary signal;

a sixth selector similar to the first selector which alternatively time division selects the outputs of the first and second counters and the outputs of the switches as the addresses of the floor-position read only memory;

a fourth position register for storing the data of the floor position of the access floor-position read only memory as the address of the outputs of the switches;

a seventh selector similar to the second selector which alternatively time division allots the output of the floor-position read only memory to the first, second and fourth floor position registers under synchronization with the sixth selector; and a circuit for forcibly resetting the position of the cage to the position of the floor predetermined by the switches by exchanging the cage position signal stored in the present position register with the floor position signal stored in the fourth floor position register.

* * * * *